US007099617B2

(12) United States Patent
Jeong et al.

(10) Patent No.: US 7,099,617 B2
(45) Date of Patent: Aug. 29, 2006

(54) WASTE TONER TRANSFER APPARATUS AND ELECTROPHOTOGRAPHIC PRINTER ADOPTING THE SAME

(75) Inventors: Heung-sup Jeong, Suwon-si (KR); Jin-soo Lee, Suwon-si (KR); Jae-myoung Choi, Suwon-si (KR); Se-hyun Lyu, Seoul (KR)

(73) Assignee: Samsung Electronics Co., Ltd., Suwon-so (KR)

( * ) Notice: Subject to any disclaimer, the term of this patent is extended or adjusted under 35 U.S.C. 154(b) by 0 days.

(21) Appl. No.: 10/835,534

(22) Filed: Apr. 30, 2004

(65) Prior Publication Data

US 2005/0002709 A1 Jan. 6, 2005

(30) Foreign Application Priority Data

Jul. 3, 2003 (KR) ..... 10-2003-0044840
Jul. 4, 2003 (KR) ..... 10-2003-0045387

(51) Int. Cl.
*G03G 21/10* (2006.01)

(52) U.S. Cl. ..... 399/358; 399/360

(58) Field of Classification Search ..... 399/99, 399/101, 120, 264, 358, 348, 359, 360
See application file for complete search history.

(56) References Cited

U.S. PATENT DOCUMENTS 4,297,021 A * 10/1981 Tani et al. ..... 399/358
4,659,212 A 4/1987 Ichihara et al. ..... 355/15
5,634,172 A 5/1997 Manabe ..... 399/35
5,778,296 A 7/1998 van der Steen et al. .... 399/360
6,014,541 A * 1/2000 Kato et al. ..... 399/358
2003/0072580 A1* 4/2003 Itoh et al. ..... 399/62

FOREIGN PATENT DOCUMENTS

| | | |
|---|---|---|
| JP | 56-150782 | 11/1981 |
| JP | 61-257811 | 11/1986 |
| JP | 61257811 | 11/1986 |
| JP | 03100588 | 4/1991 |
| JP | 06-067578 | 3/1994 |
| JP | 6-305537 | 11/1994 |
| JP | 07-114301 | 5/1995 |
| JP | 10-149005 | 6/1998 |
| JP | 11-052806 | 2/1999 |
| JP | 11-084971 | 3/1999 |
| JP | 2000-181319 | 6/2000 |
| KR | P1989-5387 | 5/1989 |
| KR | 0125954 | 12/1998 |

* cited by examiner

*Primary Examiner*—Hoang Ngo
(74) *Attorney, Agent, or Firm*—Roylance, Abrams, Berdo & Goodman, L.L.P.

(57) ABSTRACT

A waste toner transfer apparatus in an electrophotographic printer to transfer waste toner removed by a cleaning unit and transferred to a waste toner storage container. The waste toner transfer apparatus includes a duct connecting the cleaning unit and the waste toner storage container, a conveying coil having a spiral shape which is installed in the duct and rotates, and an insertion member inserted in the conveying coil.

18 Claims, 8 Drawing Sheets

WASTE TONER TRANSFER APPARATUS AND ELECTROPHOTOGRAPHIC PRINTER ADOPTING THE SAME

BACKGROUND OF THE INVENTION

This application claims benefit under 35 U.S.C. § 119(a) of Korean Patent Application No. 2003-44840 and Korean Patent Application No. 2003-45387, respectively filed on Jul. 3, 2003 and Jul. 4, 2003 in the Korean Intellectual Property Office, the entire disclosures of which are incorporated herein by reference.

1. Field of the Invention

The present invention relates to an electrophotographic printer. More particularly, the present invention relates to a waste toner transfer apparatus to transfer waste toner generated during a printing process to a waste toner storage container and an electrophotographic printer adopting the same.

2. Description of the Related Art

In an image forming process of an electrophotographic printer, when an exposure unit scans light corresponding to image information onto a photoreceptor that is charged to a predetermined electric potential, an electrostatic latent image is formed on the photoreceptor. A developing unit supplies toner to the electrostatic latent image to form a toner image. Generally, four developing unites containing toners for cyan, magenta, yellow, and black colors are needed for a color electrostatic latent printer. The toner image is transferred directly onto a recording medium, or via an intermediate medium, from the photoreceptor. While the recording medium passes through a fusing unit, the toner image is fused onto the recording medium by heat and pressure. As a result of the above processes, a mono or color image is printed on the recording medium.

While a wet type electrophotographic printer uses a wet developer formed by dispersing toner powder in a liquid carrier, a dry type electrophotographic printer uses toner powder as a developer. Waste toner remaining on the photoreceptor or the intermediate transfer medium during the image forming process is removed therefrom. The removed waste toner is transferred to a waste toner storage container. The electrophotographic printer typically includes a waste toner transfer apparatus for transferring waste toner to the waste toner storage container.

FIG. 1 is a view illustrating a conventional waste toner transfer apparatus. Referring to FIG. 1, a cleaning apparatus 1 removes waste toner from the photoreceptor or intermediate transfer medium. The waste toner removed by the cleaning apparatus 1 is transferred by a waste toner transfer apparatus 2 to a waste toner storage container (not shown). The waste toner enters a duct 4 through an inlet portion 3. A shaft 5 rotated by a drive motor 6 is installed in the duct 4 and a conveying coil 7 is coupled to an end portion of the shaft 5. The duct 4 and the waste toner storage container are connected by a pipe 8. The conveying coil 7 is installed to extend through the inside of the pipe 8. The waste toner entering the duct 4 through the inlet portion 3 is transferred by the conveying coil 7 to the waste toner storage container along the pipe 8.

FIG. 2 is a more detailed view of section "A" of the conveying coil shown in FIG. 1. The waste toner transferred along the conveying coil 7 falls in the inner space of the conveying coil 7 as indicated by arrows shown in FIG. 2. Thus, the inner space of the conveying coil 7 must be filled in order for the conveying coil 7 to transfer the waste toner to the waste toner storage container. That is, when the inside of the pipe 8 is filled with the waste toner, the waste toner is transferred to the waste toner storage container as the conveying coil 7 rotates. In this state, the density of the waste toner inside the pipe 8 gradually increases. In particular, when the waste toner is left in a high temperature and high humidity environment for a long time, the waste toner becomes solidified. Then, even when the conveying coil 7 rotates, the waste toner is not transferred and the conveying coil 7 may be destroyed or the drive motor 6 rotating the conveying coil 7 can become stalled due to an overload. Also, since the waster toner is not transferred, the waste toner is accumulated in the cleaning unit 1.

SUMMARY OF THE INVENTION

To solve the above problems and provide other advantages, embodiments of the present invention provide a waste toner transfer apparatus which effectively transfers waste toner removed from an image holding body such as a photoreceptor or an intermediate transfer medium to a waste toner storage container such that the waste toner is not accumulated on the way and an electrophotographic printer having the same.

According to an aspect of the present invention, a waste toner transfer apparatus in an electrophotographic printer is provided to transfer waste toner removed from an image holding body by a cleaning unit to a waste toner storage container adapted to hold the waste toner. The waste toner transfer apparatus comprises a duct connecting the cleaning unit and the waste toner storage container, a conveying coil having a spiral shape which is installed in the duct and rotates, and an insertion member inserted in the conveying coil.

According to another aspect of the present invention, an electrophotographic printer comprises an image holding body adapted to temporarily hold a toner image in an image forming process, a cleaning unit adapted to remove waste toner remaining on the image holding body, a waste toner storage container, and a waste toner transfer apparatus adapted to transfer the waste toner from the cleaning unit to the waste toner storage container. The waste toner transfer apparatus comprises a duct connecting the cleaning unit and the waste toner storage container, a conveying coil having a continuous spiral shape which is installed in the duct and rotates, and an insertion member inserted in the conveying coil.

The insertion member is preferably a rod member formed of a flexible material. Furthermore, the insertion member is preferably a coil having spirals closely contacting one another. The waste toner transfer apparatus further comprises a cap member adapted to prevent the insertion member from being pushed toward the waste toner storage container by a thrust force generated by the rotation of the conveying coil.

The waste toner transfer apparatus preferably further comprises an auger having a shaft and a spiral wing formed on an outer circumference of the shaft. The auger is adapted to rotate, and the conveying coil is preferably coupled to the shaft and rotates together with the auger. The duct comprises a first duct in which the waste toner enters from the cleaning unit, a second duct connected to the first duct, and a third duct which is preferably soft and connects the second duct and the storage container. The auger is preferably installed in the second duct and the conveying coil is preferably coupled to the auger and inserted into the third duct. The pitch of the spiral of the conveying coil preferably increases gradually toward the waste toner storage container.

BRIEF DESCRIPTION OF THE DRAWINGS

The above and other features and advantages of the present invention will become more apparent in connection with the following detailed description of the preferred embodiments thereof with reference to the attached drawings in which.

Throughout the drawings it should be understood that like reference numerals refer to like features and structures.

DETAILED DESCRIPTION OF THE PREFERRED EMBODIMENTS

Figure 1:
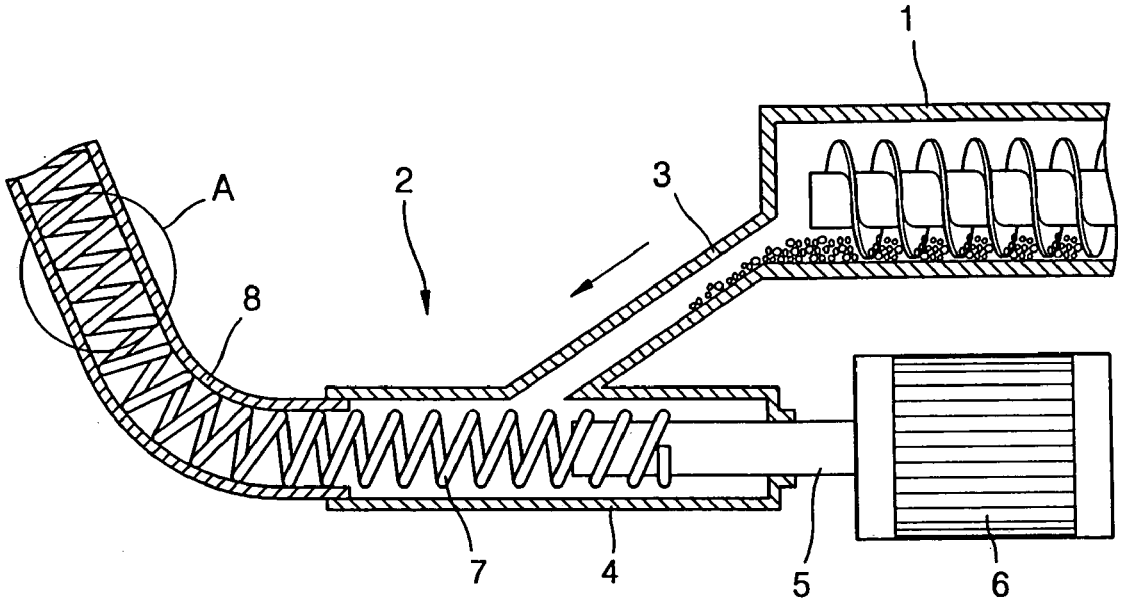
FIG. 1 (PRIOR ART)
FIG. 1 is a view illustrating a conventional waste toner transfer apparatus.
Figure 2:
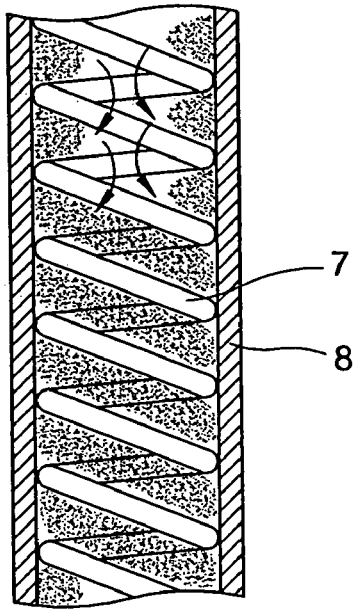
FIG. 2 (PRIOR ART)
FIG. 2 is a view illustrating portion A of FIG. 1 in greater detail.
Figure 3:
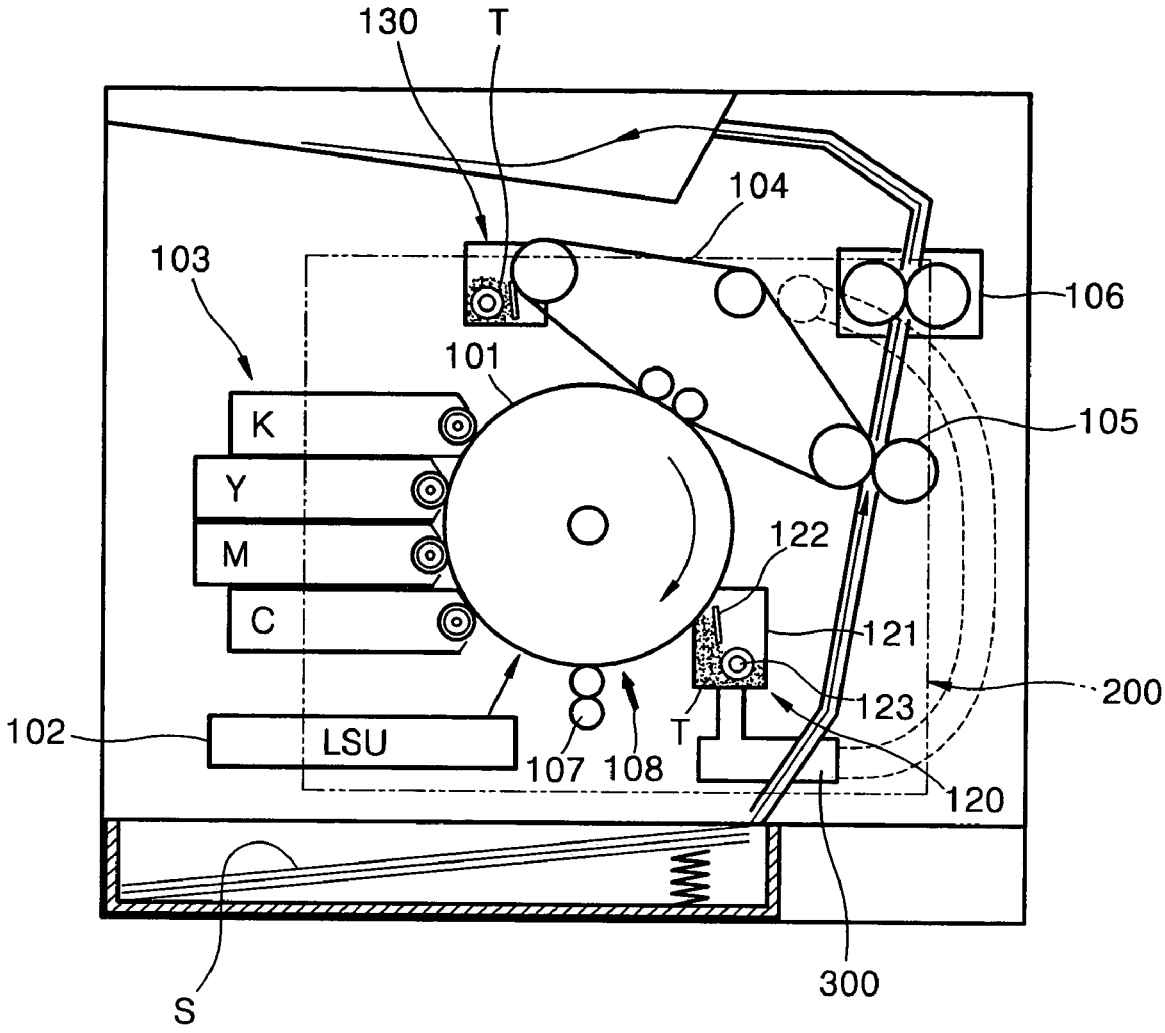
FIG. 3 is a view illustrating the structure of an electrophotographic printer according to an embodiment of the present invention.

Referring to FIG. 3, an electrophotographic printer according to an embodiment of the present invention includes a photoreceptive drum 101, an exposure unit 102, a developing unit 103, and a transfer belt 104.

Figure 4:
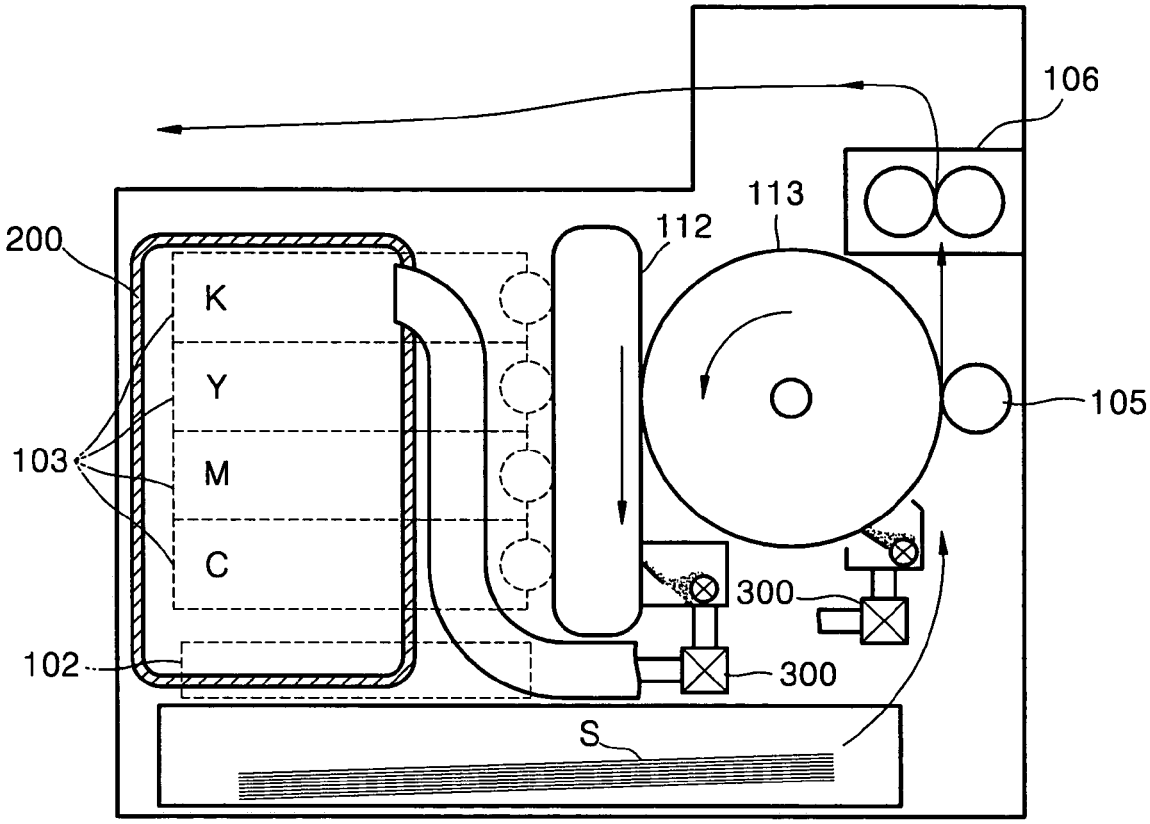
FIG. 4 is a view illustrating the structure of an electrophotographic printer according to another embodiment of the present invention.

The photoreceptive drum 101, as an example of a photoreceptor, has a photoconductive layer formed on the outer circumferential surface of a drum. A photoreceptive belt 112 as shown in FIG. 4 can be used instead of the photoreceptive drum 101.

The exposure unit 102 forms an electrostatic latent image by scanning light corresponding to image information onto the photoreceptor drum 101, which is charged to have a uniform electric potential. Generally, a laser scanning unit (LSU) using a laser diode as a light source is used as the exposure unit 102, although those of ordinary skill in the art will recognize that other devices performing a similar function may be substituted without departing from the spirit of the invention.

Four developing units 103C, 103M, 103Y, and 103K respectively contain solid powder toners for cyan (C), magenta (M), yellow (Y), and black (K) colors, and provide the toners to the electrostatic latent image formed on the photoreceptive drum 101 (or photoreceptive belt 112) to form toner images.

The transfer belt 104 is an example of an intermediate transfer medium which transfers the toner image received from the photoreceptor to a recording medium S. A transfer drum 113 as shown in FIG. 4 can be used instead of the transfer belt 104. The toner images for cyan (C), magenta (M), yellow (Y), and black (K) colors sequentially formed on the photoreceptive drum 101 are transferred to the transfer belt 104, in sequential order and are overlapped so that a color toner image is formed. Preferably, the running linear velocity of the transfer belt 104 is the same as the rotating linear velocity of the photoreceptive drum 101. The length of the transfer belt 104 is preferably the same as or longer than the length of the recording medium S onto which the color toner image is transferred.

The transfer roller 105 faces the transfer belt 104. The transfer roller 105 is separated from the transfer belt 104 while the color toner image is transferred to the transfer belt 104. When the color toner image is completely transferred to the transfer belt 104, the transfer roller 105 contacts the transfer belt 104 with a predetermined pressure to transfer the color toner image to the recording medium S. When the recording medium S to which the toner image is transferred passes through a fusing unit 106, the toner image is fused on the recording medium S by heat and pressure. A charger 107 charges the photoreceptive drum 101 to a uniform electric potential. A discharger 108 discharges electrical charges remaining on the photoreceptive drum 101.

The image forming process performed by the electrophotographic printer having the above-described structure is described below.

Color image information includes information on cyan (C), magenta (M), yellow (Y), and black (K) colors. In the embodiment illustrated herein, the color toner image for cyan (C), magenta (M), yellow (Y), and black (K) colors are sequentially overlapped on the transfer belt 104 and the overlapped image is transferred to the recording medium S. The transferred image is fused on the recording medium S so that a color image is formed.

The photoreceptive drum 101 is charged to a uniform electric potential, then a light signal corresponding to the image information for one of the colors, such as cyan (C), is scanned by the exposure unit 102 onto the photoreceptive drum 101. The resistance of a portion of the drum surface where the light is scanned decreases and charges adhering to the external circumferential surface of the photoreceptive drum 101 dissipate. As a result, a difference in electric potential is generated between the scanned portion and the non-scanned portion of the photoreceptive drum 101 so that an electrostatic latent image is formed on the outer circumferential surface of the photoreceptive drum 101. When the electrostatic latent image on the rotating drum 101 approaches the developing unit 103C for cyan (C) color, the toner for cyan (C) color contained in the developing unit 103C adheres to the electrostatic latent image so that a cyan toner image is formed. When the cyan toner image approaches the transfer belt 104 by the rotation of the transfer belt 104, the cyan toner image is transferred to the transfer belt 104 by the difference in electric potential with the transfer belt 104 and/or a contact pressure. When the cyan toner image is completely transferred to the transfer belt 104, the toner images for magenta (M), yellow (Y), and black (K) are sequentially transferred to the transfer belt 104, using the same process, and overlapped thereon to form a color toner image. When the recording medium S passes between the transfer belt 104 and the transfer roller 105, the color toner image is transferred to the recording medium S. Next, the color toner image is fused by the fusing unit 106 onto the recording medium S by heat and pressure and the recording medium S is ejected, to complete the color image forming process.

The photoreceptive drum 101 and the transfer belt 104 are image holding bodies which temporarily hold a toner image before the toner image is transferred to the recording medium S. Some toner remains on the photoreceptive drum 101 and the transfer belt 104 during the process of transferring the toner image to the recording medium S via the photoreceptive drum 101 and the transfer belt 104. The waste toner remaining on the image holding bodies is preferably removed before the next printing. The removed waste toner is held in a waste toner storage container 200 and then disposed of. In some cases, some waste toner reenters the developing unit to be reused. However, for a color image forming apparatus, since different color toners are generally mixed, the waste toner cannot be reused.

Figure 5:
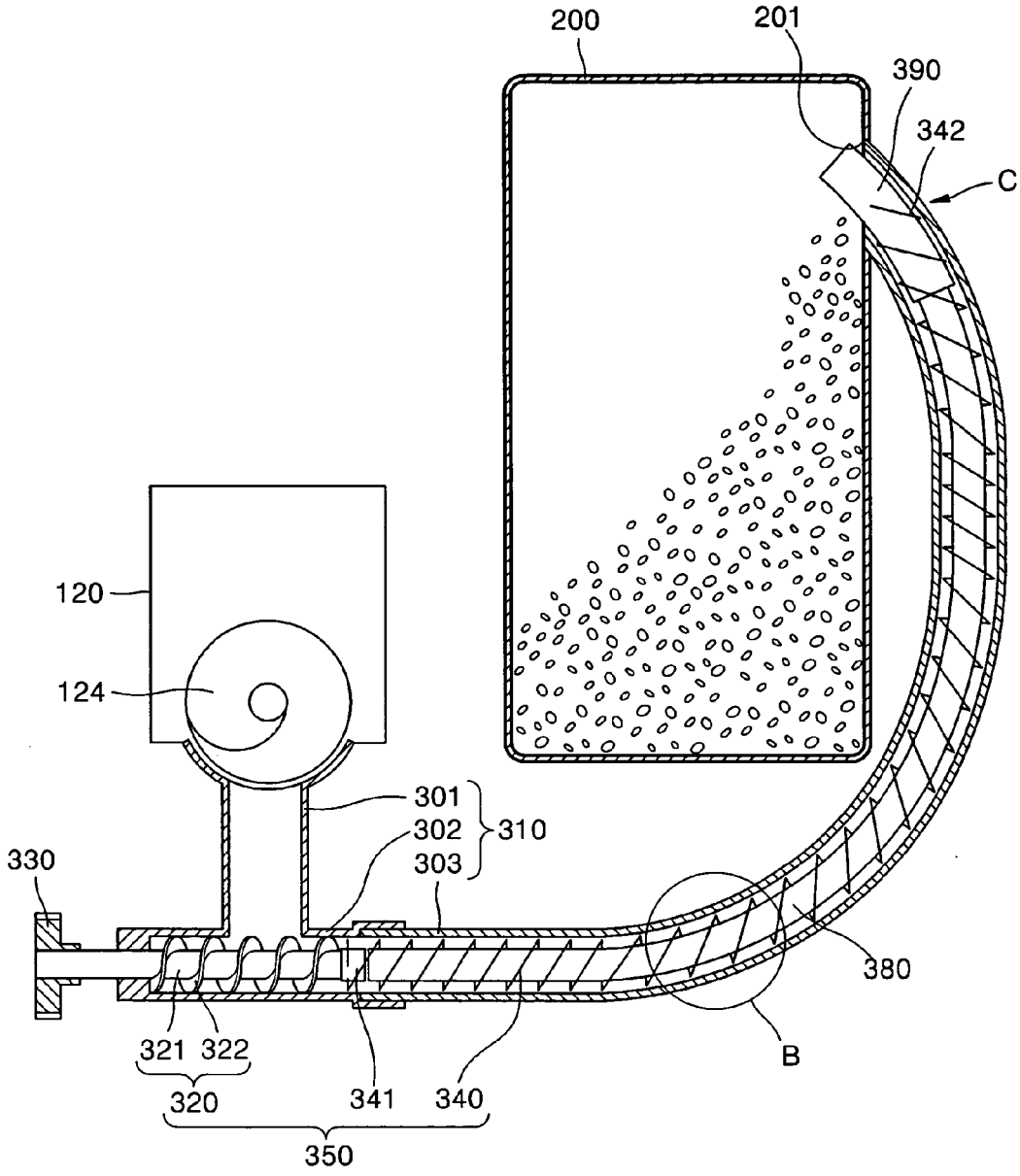
FIG. 5 is a sectional view illustrating the waste toner transfer apparatus shown in FIGS. 3 and 4.

Referring to FIG. 3, a cleaning unit 120 for removing waste toner from the photoreceptive drum 101 is shown. The cleaning unit 120 includes a housing 121, a blade 122 contacting the photoreceptive drum 101 to squeegee the waste toner, and an auger 123 to transfer the waste toner toward an outlet 124 of FIG. 5 provided at one side end portion of the housing 121. Also, another cleaning unit 130 to remove waste toner from the transfer belt 104 is provided. The cleaning unit 130 has substantially the same structure as that of the cleaning unit 120 for the photoreceptive drum 101.

As shown in FIG. 5, the waste toner storage container 200 has an inlet 201 through which waste toner enters. The inlet 201 is preferably disposed near the top of the waste toner storage container 200 to effectively hold the waste toner. In the embodiment of the present invention illustrated in FIG. 3, since the transfer belt 104 is disposed above the photoreceptive drum 101, the waste toner removed from the transfer belt 104 by the cleaning unit 130 is transferred into the waste toner storage container 200 directly through the inlet (not shown) from the cleaning unit 130. However, the waste toner removed from the photoreceptive drum 101 by the cleaning unit 120 is transferred into the waste toner storage container 200 by a waste toner transfer apparatus 300 to overcome a difference in height between the cleaning unit 120 and the inlet 201 of the waste toner storage container 200.

FIG. 4 shows an electrophotographic printer according to another embodiment of the present invention. Referring to FIG. 4, the photoreceptive belt 112 is provided parallel to a transfer drum 113. The cleaning units 120 and 130 remove waste toner from the photoreceptive belt 112 and the transfer drum 113. The electrophotographic printer having the above structure needs two waste toner transfer apparatuses 300 to transfer waste toner from the respective cleaning units 120 and 130 to the waste toner storage container 200.

Figure 6:
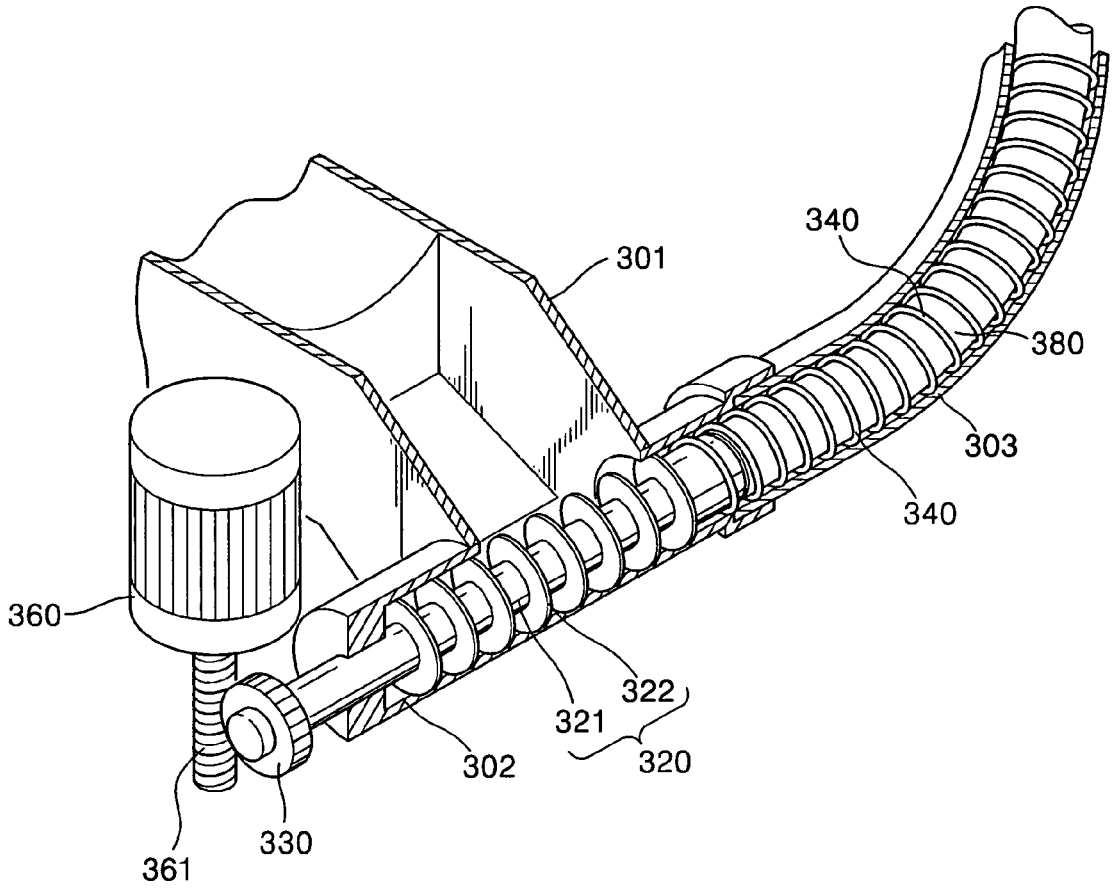
FIG. 6 is a perspective view illustrating the waste toner transfer apparatus shown in FIGS. 3 and 4.
Figure 7:
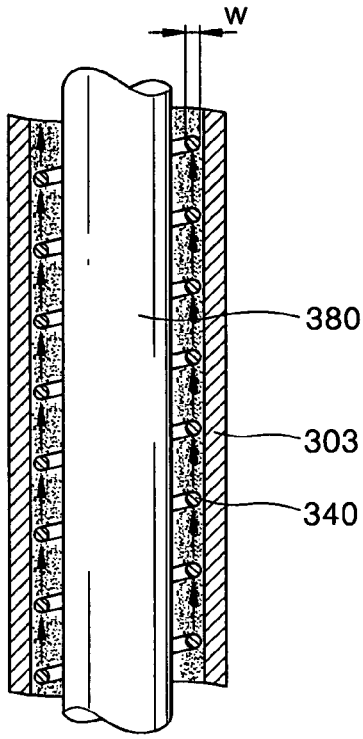
FIG. 7 is a view illustrating portion B of FIG. 5 in greater detail.
Figure 8:
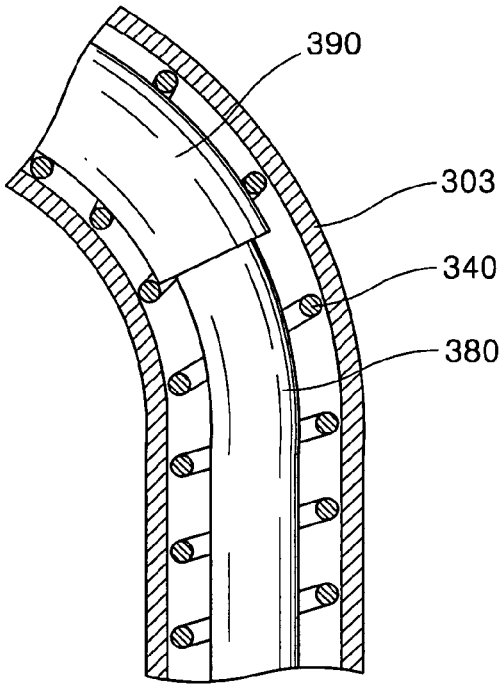
FIG. 8 is a view illustrating portion C of FIG. 5 in greater detail.

FIGS. 5 and 6 are a sectional view and a perspective view, respectively, illustrating the waste toner transfer apparatus shown in FIGS. 3 and 4. FIGS. 7 and 8 illustrate the portions B and C of FIG. 5 in detail.

Referring to FIGS. 5 and 6, a duct 310 is connected to the outlet 124 of the cleaning unit 120. A spiral shaped conveying coil 340 rotating is installed inside the duct 310. An insertion member 380 filling the inner space of the conveying coil 340 is installed inside the conveying coil 340.

The duct 310 includes first through third ducts 301, 302, and 303, in the illustrated embodiment. The first duct 301 connects the cleaning unit 120 and the second duct 302. The third duct 303 preferably has a flexible circular pipe shape which is easy to connect to the second duct 302 and the waste toner storage container 200. Thus, a waste toner transfer route is formed from the cleaning unit 120 to the waste toner storage container 200, via the first duct 301, the second duct 302, and the third duct 303.

To transfer the waste toner, the waste toner transfer unit 300 may include an auger 320 having a shaft 321 and a spiral shaped wing 322 installed in the second duct 302 and rotating, and the conveying coil 340 coupled to the shaft 321 and extending to the waste toner storage container 200. That is, as shown in FIG. 5, the auger 320 is formed such that the spiral wing 322 does not extend to the distal end of the shaft 321, and the conveying coil 340 is inserted around the outer circumference of the shaft 321 and extends to the inside of the second duct 302. The waste toner entering in the second duct 302 is transferred to the waste toner storage container 200 as the conveying coil 340 rotates. Although an auger 320 having a spiral shaped wing 322 has been described in connection with the illustrated embodiment, it will be appreciated by those of ordinary skill in the art that other mechanisms for transferring waste toner through the duct 302 may be employed. As an example, in place of the auger 320, the conveying coil 340 could extend further along the shaft 321 towards the gear 330.

To improve waste toner transfer performance, the waste toner transfer apparatus 300 according to an embodiment of the present invention includes an auger 320 in which the wing 322 having a spiral shape is formed on the outer circumference of the shaft 321 and the conveying coil 340 coupled to one end portion of the shaft 321. A gear 330 is coupled to the other end portion of the shaft 321. A drive motor 360 has a rotation shaft to which a worm gear 361 connected to the gear 330 is coupled. The drive motor 360 rotates the auger 320. One end portion 341 of the conveying coil 340 is coupled to the shaft 321 of the auger 320 and the other end portion 342 is extended through the third duct 303. The conveying coil 340 preferably is rotated together as the auger 320 rotates. The auger 320 is preferably installed in the second duct 302. The auger 320 transfers the waste toner entering in the second duct 302 through the first duct 301, to the third duct 303.

Figure 9:
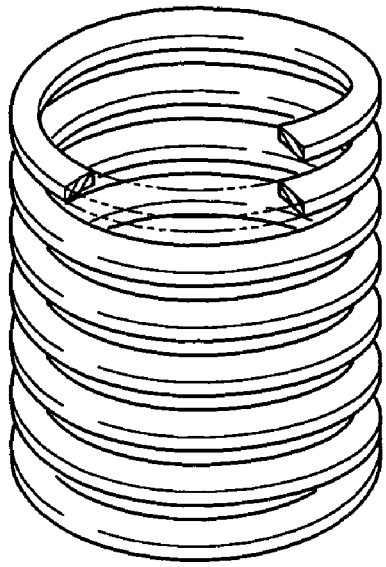
FIG. 9 is a view illustrating a conveying coil according to an embodiment of the present invention.

The sectional shape of the conveying coil 340 may be circular as shown in FIG. 7, or rectangular as shown in FIG. 9. Since the amount of waste toner transferred is related to the width (W of FIG. 7) of the cross section of the conveying coil 340 spiral, the amount of the transferred waste toner is relatively small. Thus, by further providing the auger 320 which transfers the waste toner by using the spiral wing 322, the performance of transferring the waste toner is improved. Also, the conveying coil 340 preferably has a shape such that pitch of the conveying coil 340 gradually increases toward the waste toner storage container 200. According to the conveying coil 340, the amount of the waste toner transferred during one turn of the conveying coil 340 gradually increases toward the waste toner storage container 200. Thus, since the time during which the waste toner remains in the third duct 303 can be reduced, a phenomenon that the waste toner is solidified while being transferred is more effectively prevented.

Figure 10:
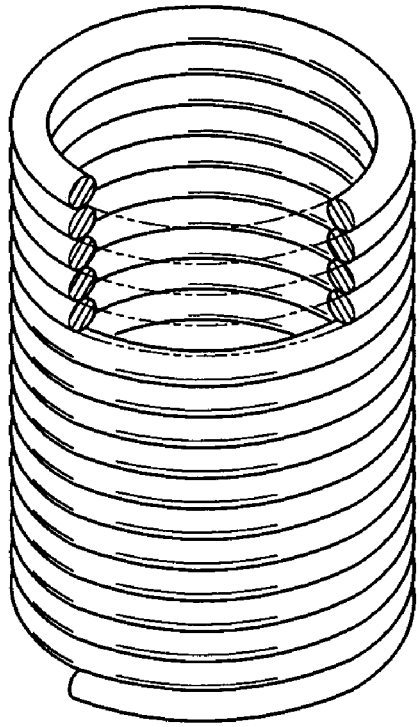
FIG. 10 is a view illustrating an insertion member according to an embodiment of the present invention.
Figure 11:
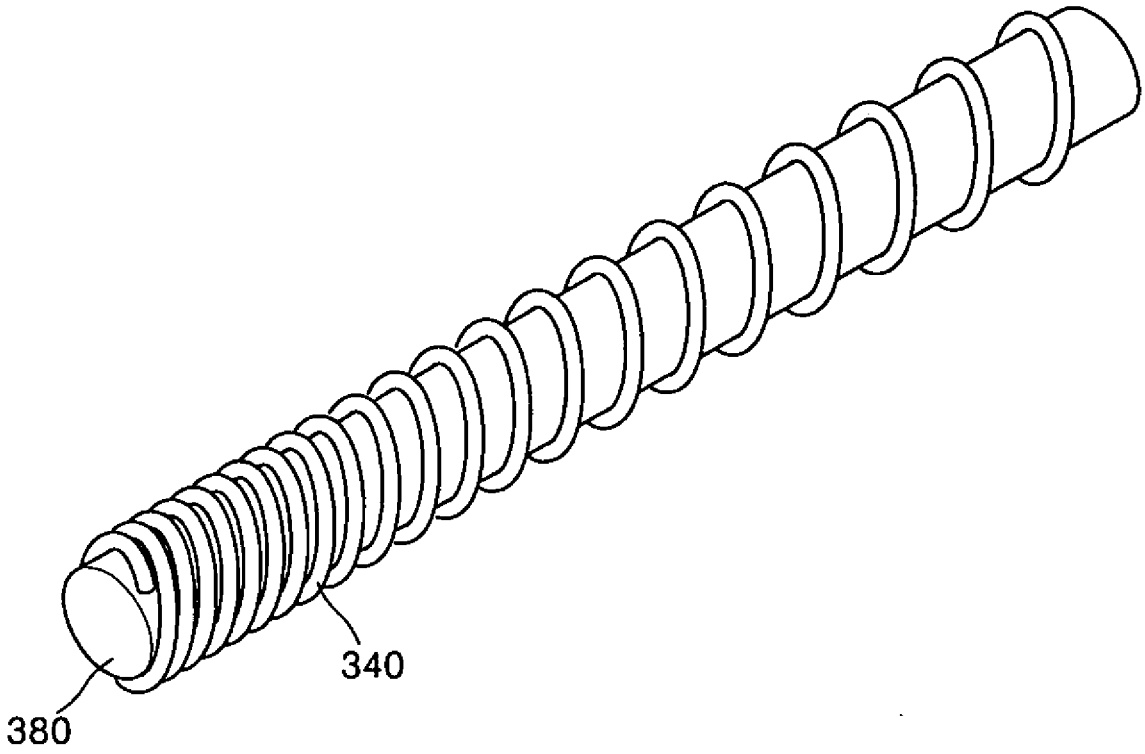
FIG. 11 is a view illustrating a conveying coil according to another embodiment of the present invention.

Referring to FIG. 7, an insertion member 380 is installed in the conveying coil 340 to prevent the inner space of the conveying coil 340 from being filled with the waste toner. Preferably, the insertion member 380 is flexible. The insertion member 380 may be installed to closely contact the conveying coil 340 or be separated a predetermined distance therefrom. The insertion member 380 may be a rubber rod as shown in FIG. 7. Also, the insertion member 380 may be a coil having spirals closely contacting one another, as shown in FIG. 10.

FIG. 8 illustrates a cap member 390. The insertion member 380 may be pushed toward the waste toner storage container 200 by a rotational thrust force of the conveying coil 340, which can be prevented by the cap member 390. The cap member 390 can be closely inserted around the end portion 342 of the conveying coil 340 at the side of the waste toner storage container 200. Thus, even if the rotational thrust force of the conveying coil 340 acts on the insertion member 380, the insertion member 380 is not pushed because it is stopped by the cap member 390.

The operation and effect of the waste toner transfer apparatus 300 is described below with reference to FIGS. 5 through 11.

The waste toner removed from the photoreceptive drum 101 by the cleaning apparatus 120 enters in the second duct 302 along the first duct 301. When the drive motor 360 rotates, the auger 320 in the second duct 302 rotates and the conveying coil 340 in the third duct 303 rotates together. The waste toner in the second duct 302 enters in the third duct 303 by being pushed by the spiral wing 322 of the auger 320 and is transferred to the waste toner storage container 200 along the conveying coil 340.

The conveying coil 340 rotates in the third duct 303 by being engaged with the auger 320. Since the insertion member 380 is installed in the conveying coil 340, the waste toner does not fill the inside of the conveying coil 340. The insertion member 380 receives a thrust force generated by the rotation of the conveying coil 340 so as to be pushed toward the waste toner storage container 200. When the insertion member 380 is pushed toward the waste toner storage container 200 by the thrust force, an inner space is formed in the conveying coil 340 at the end portion 341 close to the second duct 302 so that the space is filled with the waste toner. However, in a preferred embodiment, the cap member 390 coupled to the end portion 341 of the conveying coil 340 close to the waste toner storage container 200 prevents the insertion member 380 from being pushed.

Thus, since the waste toner entering from the cleaning unit 120 is quickly transferred to the waste toner storage container 200, the phenomenon that the waste toner left in the duct 310 is solidified can be prevented. Consequently, a damage to the conveying coil and stalling of the drive motor due to the solidification of the waster toner in the conventional waste toner transfer apparatus can be prevented.

As described above, in the electrophotographic printer according to the present invention, since the insertion member 380 is inserted in the conveying coil 340, the waste toner entering from the cleaning unit can be quickly transferred to the waste toner storage container without building up in the interior of the conveying coil 340.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A waste toner transfer apparatus in an electrophotographic printer for transferring waste toner to a waste toner storage container, the waste toner transfer apparatus comprising:

a flexible duct connecting a cleaning unit and the waste toner storage container;

a flexible conveying coil which is installed in the duct and rotates; and a flexible insertion member inserted in the conveying coil to substantially fill the interior space of the conveying coil.

2. The waster toner transfer apparatus as claimed in claim 1, wherein the conveying coil has a spiral shape.

3. The waste toner transfer apparatus as claimed in claim 1, wherein the insertion member comprises a rod member.

4. A waste toner transfer apparatus in an electrophotographic printer for transferring waste toner to a waste toner storage container, the waste toner transfer apparatus comprising:

a duct connecting a cleaning unit and the waste toner storage container;

a conveying coil which is installed in the duct and rotates; and an insertion member inserted in the conveying coil to substantially fill the interior space of the conveying coil wherein the insertion member is a coil having spirals closely contacting one another.

5. A waste toner transfer apparatus in an electrophotographic printer for transferring waste toner to a waste toner storage container, the waste toner transfer apparatus comprising:

a duct connecting a cleaning unit and the waste toner storage container;

a conveying coil which is installed in the duct and rotates;

an insertion member inserted in the conveying coil to substantially fill the interior space of the conveying coil; and a cap member preventing the insertion member from being pushed toward the waste toner storage container by a thrust force generated by the rotation of the conveying coil.

6. The waste toner transfer apparatus as claimed in claim 5, wherein the cap member is coupled to an end portion of the conveying coil close to the waste toner storage container.

7. The waste toner transfer apparatus as claimed in claim 1, further comprising a rotating auger having a shaft and a spiral wing formed on an outer circumference of the shaft, wherein the conveying coil is coupled to the shaft and rotated together with the auger.

8. The waste toner transfer apparatus as claimed in claim 7, wherein the duct comprises:

a first duct in which the waste toner enters from the cleaning unit;

a second duct connected to the first duct; and a third duct which is flexible and connects the second duct and the waste toner storage container, wherein the auger is installed in the second duct and the conveying coil is coupled to the auger and inserted in the third duct.

9. The waste toner transfer apparatus as claimed in claim 1, wherein a pitch of the spiral of the conveying coil increases toward the waste toner storage container.

10. An electrophotographic printer including a cleaning unit for removing waste toner from an image holding body, a waste toner storage container, and a waste toner transfer apparatus transferring the waste toner from the cleaning unit to the waste toner storage container, wherein the waste toner transfer apparatus comprises:

a flexible duct connecting the cleaning unit and the waste toner storage container;

a flexible conveying coil which is installed in the duct and rotates; and a flexible insertion member inserted in the conveying coil to substantially fill the interior space of the conveying coil.

11. The waste toner transfer apparatus as claimed in claim 10, wherein the conveying coil has a continuous spiral shape.

12. The waste toner transfer apparatus as claimed in claim 10, wherein the insertion member comprises a rod member.

13. An electrophotographic printer including a cleaning unit for removing waste toner from an image holding body, a waste toner storage container, and a waste toner transfer apparatus transferring the waste toner from the cleaning unit to the waste toner storage container, wherein the waste toner transfer apparatus comprises:

a duct connecting the cleaning unit and the waste toner storage container;

a conveying coil which is installed in the duct and rotates; and an insertion member inserted in the conveying coil to substantially fill the interior space of the conveying coil wherein the insertion member comprises a coil having spirals closely contacting one another.

14. An electrophotographic printer including a cleaning unit for removing waste toner from an image holding body, a waste toner storage container, and a waste toner transfer apparatus transferring the waste toner from the cleaning unit to the waste toner storage container, wherein the waste toner transfer apparatus comprises:

a duct connecting the cleaning unit and the waste toner storage container;

a conveying coil which is installed in the duct and rotates;

an insertion member inserted in the conveying coil to substantially fill the interior space of the conveying coil; and a cap member for preventing the insertion member from being pushed toward the waste toner storage container by a thrust force generated by the rotation of the conveying coil.

15. The waste toner transfer apparatus as claimed in claim 14, wherein the cap member is coupled to an end portion of the conveying coil close to the waste toner storage container.

16. The waste toner transfer apparatus as claimed in claim 10, further comprising an auger having a shaft and a spiral wing formed on an outer circumference of the shaft and rotating, wherein the conveying coil is coupled to the shaft and rotated together with the auger.

17. The waste toner transfer apparatus as claimed in claim 16, wherein the duct comprises:

a first duct in which the waste toner enters from the cleaning unit;

a second duct connected to the first duct; and a third duct which is soft and connects the second duct and the waste toner storage container, wherein the auger is installed in the second duct and the conveying coil is coupled to the auger and inserted in the third duct.

18. The waste toner transfer apparatus as claimed in claim 11, wherein pitch of the spiral of the conveying coil gradually increases toward the waste toner storage container.

* * * * *